US005083320A

United States Patent [19]

Halstead

[11] Patent Number: 5,083,320

[45] Date of Patent: Jan. 28, 1992

[54] PROTECTIVE HELMET WITH SELF-CONTAINED AIR PUMP

[75] Inventor: Peter D. Halstead, Knoxville, Tenn.

[73] Assignee: Athletic Helmet, Inc., Knoxville, Tenn.

[21] Appl. No.: 632,900

[22] Filed: Dec. 24, 1990

[51] Int. Cl.[5] ..... A42B 3/12

[52] U.S. Cl. ..... 2/413

[58] Field of Search ..... 2/410, 411, 413, 417, 2/425

[56] References Cited

U.S. PATENT DOCUMENTS

| | | | |
|---|---|---|---|
| D. 249,397 | 9/1978 | Humphrey et al. | D2/233 |
| D. 253,436 | 11/1979 | Lynn | D2/232 |
| D. 272,769 | 2/1984 | Sundahl et al. | D2/231 |
| D. 285,980 | 10/1986 | McNabb | D29/12 |
| D. 289,568 | 4/1987 | Nimmons | D29/16 |
| D. 289,569 | 4/1987 | Nimmons | D29/16 |
| D. 293,496 | 12/1987 | Gentes | D29/12 |
| D. 299,978 | 2/1989 | Chiarella | D29/12 |
| D. 303,851 | 10/1989 | Gentes | D29/12 |
| 935,556 | 9/1909 | Smith | 2/171.4 |
| 1,347,046 | 7/1920 | McDonough | 2/410 |
| 2,150,290 | 3/1939 | Mulvey | 2/3 |
| 2,594,478 | 4/1952 | Moore | 2/3 |
| 2,923,941 | 2/1960 | Roth et al. | 2/3 |
| 3,082,428 | 3/1963 | Zbikowski | 2/3 |
| 3,100,498 | 8/1963 | Gibson | 137/223 |
| 3,186,004 | 6/1965 | Carlini | 2/3 |
| 3,274,612 | 9/1966 | Merriam | 2/3 |
| 3,289,212 | 12/1966 | Morgan | 2/3 |
| 3,344,433 | 10/1967 | Stapenhill | 2/3 |
| 3,462,763 | 8/1969 | Schneider | 2/3 |
| 3,496,854 | 2/1970 | Feldmann et al. | 98/1 |
| 3,600,714 | 8/1971 | Cade et al. | 2/3 |
| 3,668,704 | 6/1972 | Conroy et al. | 2/3 R |
| 3,729,744 | 5/1973 | Rappleyea | 2/3 R |
| 3,761,959 | 10/1973 | Dunning | 2/3 R |
| 3,783,450 | 1/1974 | O'Connor | 2/3 R |
| 3,806,950 | 4/1974 | Spencer-Foote | 2/3 R |
| 3,866,243 | 2/1975 | Morgan | 2/413 |
| 3,873,997 | 4/1975 | Gooding | 2/3 R |
| 3,925,821 | 12/1975 | Lewicki | 2/3 R |
| 3,994,022 | 11/1976 | Villari | 2/413 |
| 4,023,213 | 5/1977 | Rovani | 2/413 |
| 4,035,846 | 7/1977 | Jencks | 2/413 |
| 4,038,700 | 8/1977 | Gyory | 2/413 |
| 4,075,714 | 2/1978 | Ryder et al. | 2/6 |
| 4,115,874 | 9/1978 | Hasegawa | 2/425 |
| 4,141,085 | 2/1979 | Adams, Sr. | 2/410 |

(List continued on next page.)

FOREIGN PATENT DOCUMENTS

| | | |
|---|---|---|
| 528639 | 7/1956 | Canada . |
| 1059251 | 7/1979 | Canada . |
| 1059252 | 7/1979 | Canada . |
| 1059260 | 7/1979 | Canada . |
| 1072252 | 2/1980 | Canada . |
| 2625210C2 | 6/1976 | Fed. Rep. of Germany . |
| 2625211C2 | 6/1976 | Fed. Rep. of Germany . |
| 3605849A1 | 2/1986 | Fed. Rep. of Germany . |
| 646754 | 1/1928 | France . |
| 1187236 | 11/1957 | France . |
| 8017134 | 2/1982 | France . |
| 8204838 | 9/1983 | France . |
| 29452/71 | 10/1971 | Japan . |
| 30570/71 | 10/1971 | Japan . |
| 3709 | 2/1975 | Japan . |
| 60-55601 | 12/1985 | Japan . |
| 721048 | 12/1954 | United Kingdom . |
| 2075820A | 11/1981 | United Kingdom . |

OTHER PUBLICATIONS

Bike Product Brochure (date unknown).
Riddel AF2 flyer (date unknown).

*Primary Examiner*—Werner H. Schroeder
*Assistant Examiner*—Michael A. Neas
*Attorney, Agent, or Firm*—Willian, Brinks, Olds, Hofer, Gilson & Lione

[57] ABSTRACT

A protective helmet having an outer shell and an inner liner is disclosed. The liner includes a plurality of air compartments interconnected by a number of air channels. A self-contained, tactile actuatable air pump is mounted to the helmet so as to be carried thereby even when the helmet is in use.

8 Claims, 2 Drawing Sheets

U.S. PATENT DOCUMENTS

| | | | |
|---|---|---|---|
| 4,324,005 | 8/1982 | Willis | 2/413 |
| 4,354,284 | 10/1982 | Gooding | 2/413 |
| 4,434,514 | 3/1984 | Sundahl et al. | 2/425 |
| 4,443,891 | 4/1984 | Blomgren et al. | 2/414 |
| 4,566,137 | 1/1986 | Gooding | 2/413 |
| 4,653,123 | 3/1987 | Broersma | 2/425 |
| 4,667,348 | 5/1987 | Sundahl | 2/410 |
| 4,766,614 | 8/1990 | Cantwell et al. | 2/414 |
| 4,901,373 | 2/1990 | Broersma | 2/421 |
| 4,903,,348 | 2/1990 | Broersma | 2/421 |
| 4,903,350 | 2/1990 | Gentes et al. | 2/421 |
| 5,003,631 | 4/1991 | Richardson | 2/413 |
| 5,014,365 | 5/1991 | Schulz | 2/413 |
| 5,014,366 | 5/1991 | Discipio, Sr. | 2/413 |

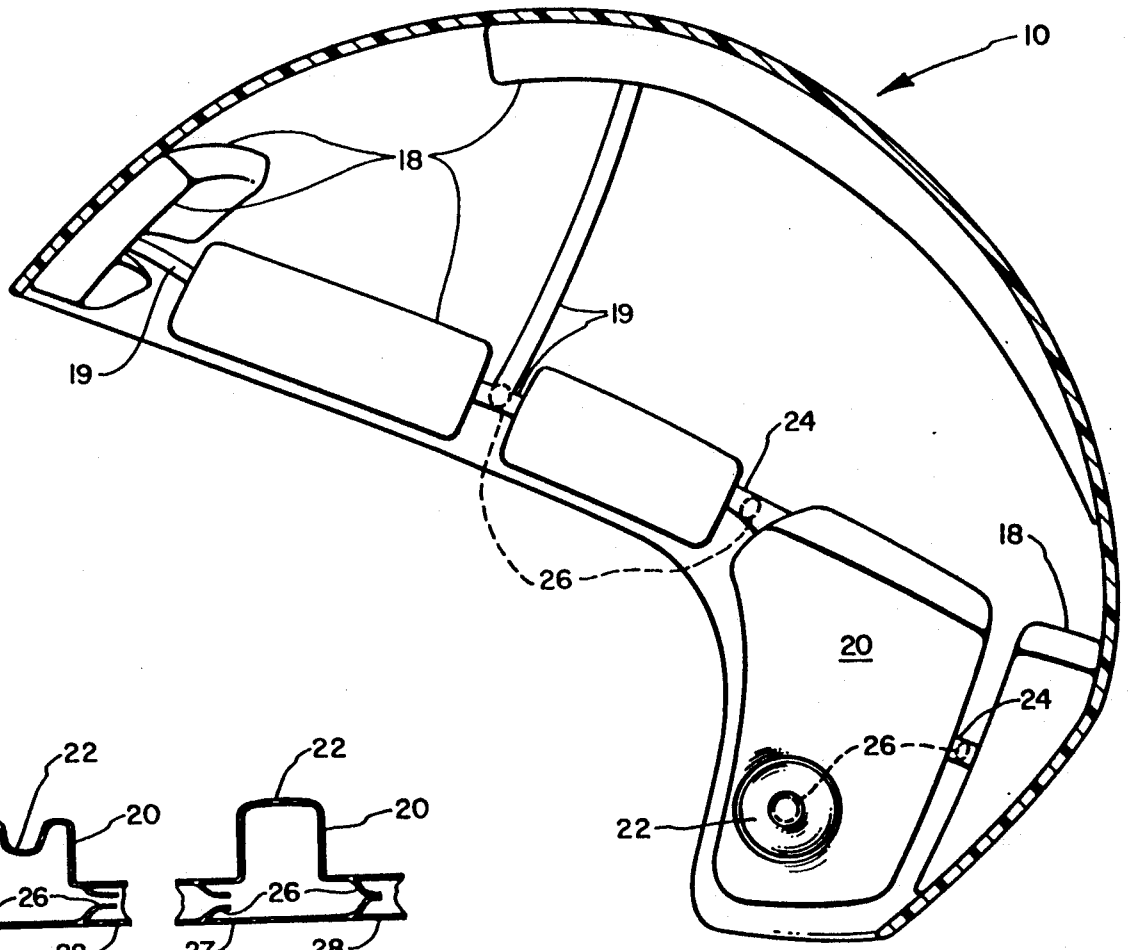
FIG. 1
FIG 3c
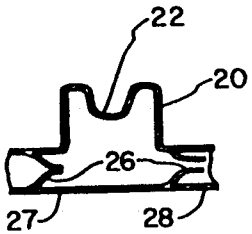
FIG. 3b
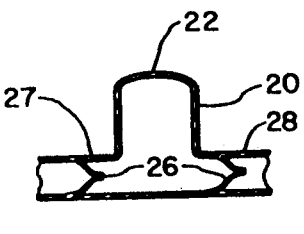
FIG. 3a

PROTECTIVE HELMET WITH SELF-CONTAINED AIR PUMP

BACKGROUND OF THE INVENTION

This invention generally relates to a protective helmet, and in particular relates to a protective helmet typically having an outer shell and an inner liner. More particularly, this invention relates to such protective helmets wherein the inner liner is formed, at least in part, of inflatable air compartments which, when filled with air, may provide increased protection and/or a better fit for the wearer.

For many years, helmets of the type described have been in wide-spread use as a protective headgear for participants in sports, such as American football. In that application, the air compartments are inflated by an external pump which is coupled to the air compartments by a removable tube that extends through a hole in the top of the helmet's outer shell. After the air compartments have been filled with air, the tube is detached, withdrawn from the hole in the top of the helmet and removed. At least a portion of the helmet liner used in such a helmet is shown in U.S. Pat. Nos. 4,014,048 and 4,566,137, the specifications thereof being incorporated herein by reference.

Though helmets of the type described have been successful, whenever additional air is needed or desired, the tube and air pump must be reattached Though this may be a relatively simple matter in a sport such as American football, where the tube and air pump can be made readily available on the sidelines, it presents a greater inconvenience for other activities such as hiking, skateboarding, etc. where the tube and air pump may not be as accessible. Moreover, in situations where the same helmets are often used by different people, the amount of air in the air compartments may need to be increased or decreased with each use to afford optimum protection and/or fit. In such cases, and others, it may be relatively inconvenient to repeatedly obtain, attach and then remove the tube and air pump used in protective helmets of the prior art.

Accordingly, it is a primary object of this invention to provide an improved protective helmet. It is a further object of this invention to provide an improved protective helmet of the type typically having an outer shell and an inner liner formed, at least in part, of inflatable air compartments. Other objects of the invention, along with numerous features and advantages, will be more clear from the summary of the invention, and the detailed description of the preferred embodiments, set forth below.

SUMMARY OF THE INVENTION

The objects of the invention referred to above are achieved in a protective helmet comprising an outer shell and a liner disposed therein. The liner includes, at least in part, at least one and preferably a plurality of inflatable air compartments and a number of channels interconnecting the air compartments. A self-contained, tactile actuatable air pump is mounted to the helmet so as to be carried thereby even when the helmet is in use. The pump is in fluid communication with at least one of the air compartments, whereby actuation of the air pump causes air to flow from the pump to the air compartments.

DETAILED DESCRIPTION OF THE DRAWINGS

Figure 2:
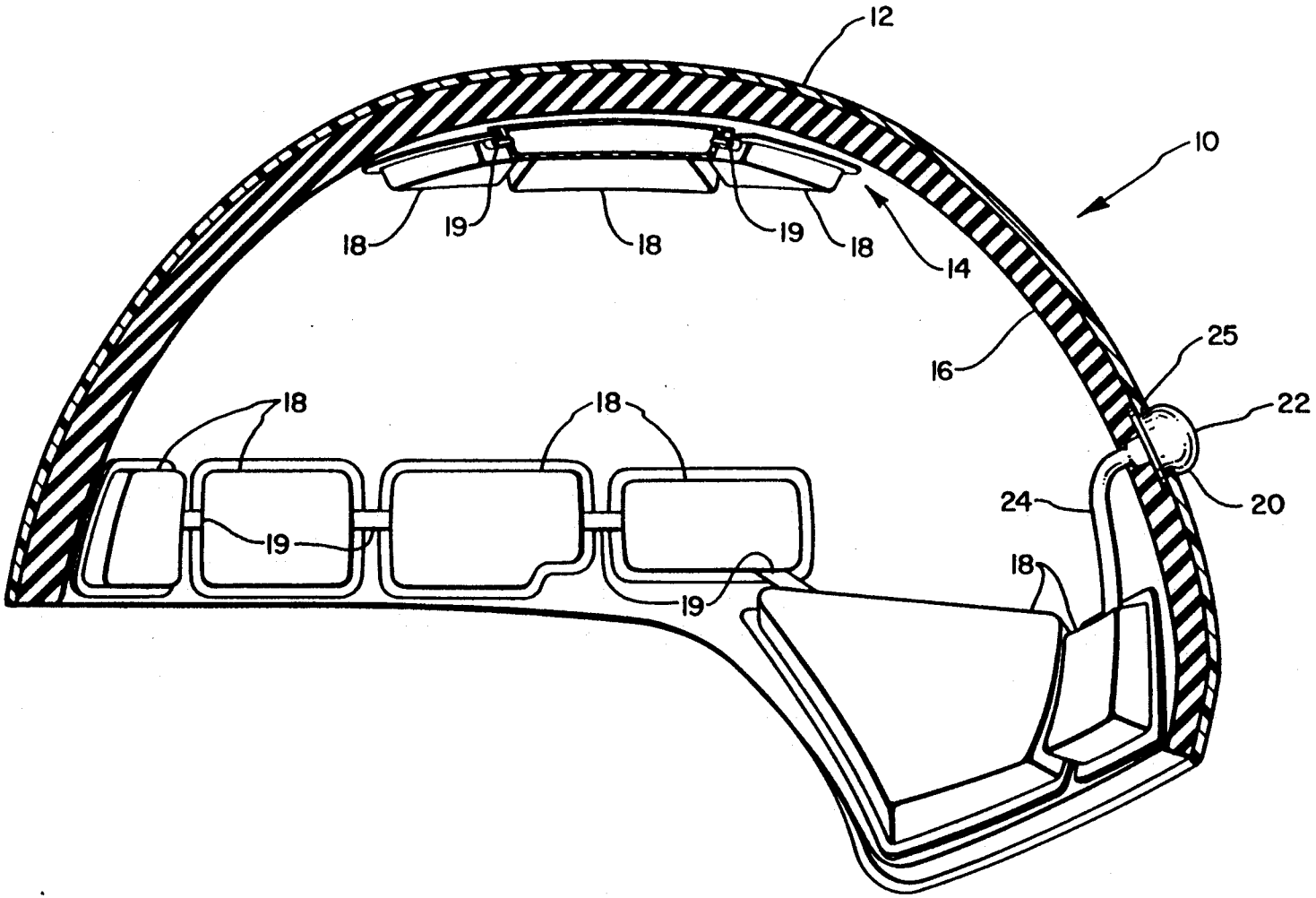

The invention summarized above is shown in the accompanying drawings wherein:

FIG. 1 is a schematic view of one preferred embodiment of a protective helmet of the invention; and FIG. 2 is a schematic view, partially in cross-section of another preferred embodiment of the protective helmet of the invention; and FIGS. 3A–3C represent schematic views of a portion of a pump/check valve assembly which may be used in connection with the preferred embodiments of the invention.

DETAILED DESCRIPTION OF THE PREFERRED EMBODIMENTS OF THE INVENTION

Referring now to the Figures, and in particular to FIGS. 1 and 2, there is shown the preferred embodiments of the protective helmet of the invention identified generally by reference numeral 10. As shown best in FIG. 2, protective helmet 10 is comprised of an outer shell 12 which may be of any desired shape, depending on the sport or activity for which it is intended to be used. In general, however, helmet 10 is molded to conform to the general contour of a typical user's head. The outer shell 12 may be formed of any suitable material, preferably a material which is hard and durable, 0.080 inches of ABS plastic being exemplary.

Disposed within outer shell 12 is a liner 14. Liner 14 may include a shock absorbent layer 16 of softer, lighter material secured, for example, to the interior of outer shell 12. This layer 16 of shock absorbent material may, for example, be a ⅜" layer of expanded polystyrene or expanded polypropylene. In certain applications, where the weight of the helmet 10 must be reduced to a minimum, the outer shell 12 may be eliminated and the layer 16 may serve as the outermost portion of helmet 10.

Liner 14 also preferably includes a plurality of inflatable air compartments 18 mounted inside helmet 10 and preferably disposed interiorly at the top, sides, front and back thereof. Air compartments 18 are preferably made from any flexible, substantially impermeable material, a thermoplastic elastomer such as DuPont Hytrel or B.F. Goodrich Estane being exemplary. The various air compartments 18 are interconnected by a number of air channels 19. The particular number, arrangement and design of the air compartments 18 and air channels 19 are a matter of choice for those skilled in the art, arrangements and using other than those specifically shown in the Figures herein being suggested in the aforementioned U.S. Pat. Nos. 4,014,048 and 4,566,137.

The protective helmet 10 also includes a self-contained, tactile-actuatable air pump identified generally by reference numeral 20. In FIG. 1, for example, the air pump 20 may be formed of the same material as any of the above-described air pockets 18. However, air pump 20, which is mounted interiorly of the outer shell, includes a tactile actuatable portion 22, accessible from outside helmet 10. One or more air channels 24 may be used to connect air pump 20 to adjacent air compartments 18 also shown in FIG. 1.

In operation, air pump 20 is normally filled with air available from outside helmet 10 via a common one-way "duck-bill" check valve 26 of the type which is well known to those skilled in the art. Similar check valves 26 may also be placed in air channels 24 to permit air flow to air compartments 18, but substantially block air flow in the opposite direction. Thus, when the tactile actuatable portion 22 of air pump 20 is depressed, such as pushing down on tactile actuatable portion 22 with a finger tip, air is forced from air pump 20 via air channels 24 and through check valves 26 therein, to adjacent air compartments 18. The air may then pass to the other air compartments 18 by virtue of the interconnecting air channels 19. Repeated actuation of the air pump 20 causes the air compartments 18 to become filled with the desired volume of air.

A slightly different arrangement is shown in FIG. 2 wherein the air pump 20 may be a conventional bladder of the type commonly used in certain athletic shoes manufactured by Reebok, Inc. As shown in FIG. 2, the air pump 20 has a tactile actuatable portion 22 which preferably extends, at least in part, through a hole or access port 25 defined in the outer shell 12 of protective helmet 10. Alternatively, the tactile actuatable portion 22 is flush with, or recessed in, the outer shell 12, but in any of the alternatives described, it is readily accessible from outside the protective helmet 10. As further shown in FIG. 2, an air channel 24 connects the air pump 20 to one or more adjacent air compartments 18, whereby the air compartments 18 can be filled to the desired volume of air by repeatedly depressing the tactile actuatable portion 22 as described above in connection with the description of FIG. 1. Air channel 24 and/or air channels 18 may also include the aforementioned check valves previously described.

Air can be removed from the air compartments 18 via air pump 20 in any of several ways. For example, an inflation pin, or similar device, can be inserted through the check valve 26 disposed in the air pump 20 shown in FIG. 1, thereby allowing air to pass from air pump 20 to the environment outside protective helmet 10. Alternatively, various arrangements apparent from the aforementioned U.S. Pat. Nos. 4,014,048 and 4,566,137 may be employed.

Another arrangement is shown in FIGS. 3A–3C, wherein a schematic representation of an air pump 20 of the types previously described is shown. Air pump 20 includes an inlet 27 and an outlet 28 each having a check valve 26. In its quiescent condition shown in FIG. 3A, air pump 20 is filled with air that has been passed from outside the helmet via inlet 27. The check valves 26 in inlet 27 and outlet 28 are, of course, both in the closed position.

When the tactile actuatable portion 22 is depressed, the check valve 26 in outlet 28 opens and air is passed to the air compartments inside the helmet. When the tactile actuatable portion 22 is released, the check valve 26 in outlet 28 closes, and the check valve 26 in inlet 27 opens, causing air to re-enter air pump 22. When the air pump 20 is again filled with air, it is ready to be actuated again.

Air can be released from the air compartments inside the protective helmet by squeezing the tubes defined by inlet 27 and outlet 28 thereby opening both check valves 26 to provide an air path from inside the protective helmet, through the air pump, to the outside environment. This arrangement obviates the need for sticking a pin or other device through one or more of the check valves to release air. Of course, other arrangements for releasing air will be apparent to those skilled in the art.

What has been described is an improved protective helmet having a self-contained air pump which can be carried by the helmet even while the helmet is in use. As such, air can be readily introduced to, or released from, air compartments inside the helmet to conveniently and expeditiously provide optimum protection and/or fit. Though the embodiments disclosed herein are preferred, numerous changes and modifications which do not part from the true scope of the invention will become apparent to those skilled in the art. Accordingly, all such changes and modifications are intended to be covered by the following claims.

I claim:

1. A protective helmet comprising:

an outer shell;

a liner disposed within said shell including a plurality of inflatable air compartments and a number of air channels interconnecting said compartments; and a self-contained tactile actuatable pump, mounted to said helmet interiorly of said outer shell so as to be carried thereby even when said helmet is in use, said pump being in fluid communication with at least on of said compartments, whereby actuation of said air pump causes air to flow from said air pump to said air compartments.

2. The helmet defined in claim 1, further including an air passage between said pump and said at least one of said compartments.

3. The helmet defined in claim 1, further including an air check valve disposed between said air pump and said at least one of said air compartments for permitting air to flow from said pump to said at least one of said air compartments, but substantially blocking the flow of air from said at least one of said air compartments to said air pump.

4. The helmet defined in claim 3, further including an air passage between said pump and said at least one of said air compartments, wherein said check valve is disposed within said air passage.

5. The helmet defined in claim 1, further including valve means for releasing air from said air compartments.

6. The protective helmet defined in claim 1, wherein said liner includes shock absorbent material which is not in fluid communication with said pump.

7. A protective helmet comprising:

an outer shell;

an inner liner disposed within said shell including at least one inflatable air compartment; and a self-contained tactile actuatable air pump, mounted to said helmet interiorly of said outer shell so as to be carried thereby even when said helmet is in use, said pump being in fluid communication with said air compartment, whereby actuation of said air pump causes air to flow from said air pump to said air compartment.

8. A protective helmet comprising:

a liner formed of shock absorbent material, defining at least a portion of the exterior of said helmet;

a plurality of inflatable air compartments mounted to said helmet; and a self-contained tactile actuatable air pump, mounted to said helmet interiorly of said outer shell so as to be carried thereby even when said helmet is in use, said pump being in fluid communication with said air compartments whereby actuation of said pump causes air to flow from said air pump to said air compartments.

* * * * *